United States Patent [19]

Wilkinson et al.

[11] Patent Number: 4,467,933

[45] Date of Patent: Aug. 28, 1984

[54] WARP RESISTANT CLOSURE FOR SANITARY CANS

[75] Inventors: Harlen E. Wilkinson, Crystal Lake, Ill.; Theodore Sopher, La Crescenta, Calif.

[73] Assignee: American Can Company, Greenwich, Conn.

[21] Appl. No.: 311,910

[22] Filed: Oct. 16, 1981

[51] Int. Cl.[3] ..... B65D 8/08

[52] U.S. Cl. ..... 220/66; 220/67

[58] Field of Search ..... 220/66, 67, 1 BC, 70, 220/270, 276, 284

[56] References Cited

U.S. PATENT DOCUMENTS

| | | | |
|---|---|---|---|
| 1,987,817 | 1/1935 | Burns | 220/66 |
| 2,119,533 | 6/1938 | Fink | 220/276 |
| 3,142,280 | 7/1964 | Heinle | 220/270 X |
| 3,341,058 | 9/1967 | Martin | 220/66 |
| 3,362,570 | 1/1968 | Geiger | 220/284 |
| 3,628,689 | 12/1971 | Rogers | 220/270 |
| 3,638,825 | 2/1972 | Franek et al. | 220/66 |
| 3,814,279 | 6/1974 | Rayzal | 220/66 |
| 3,891,116 | 6/1975 | Schane | 220/270 |
| 4,010,867 | 3/1977 | Jones | 220/66 |

*Primary Examiner*—Allan N. Shoap

*Attorney, Agent, or Firm*—Paul R. Audet; Aaron Passman; Warren N. Low

[57] ABSTRACT

A closure for sanitary or food cans made from high temper plate to withstand the high pressure developed during processing without permanent distortion or buckling. A upwardly directed reinforcing annular bead is introduced concentric with a countersink groove which is disposed between the end flange and said annular bead. The ends are further contoured with a series of transitional steps or panels inward of said annular bead. These features enhance the strength of the closure without inducing substantial warpage.

6 Claims, 5 Drawing Figures

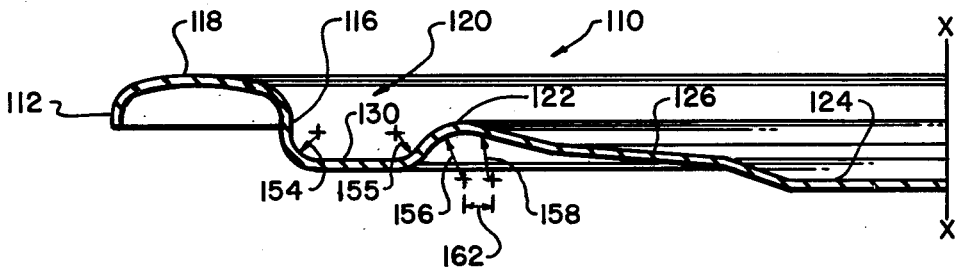
FIG. 5
PRIOR ART
FIG. 4
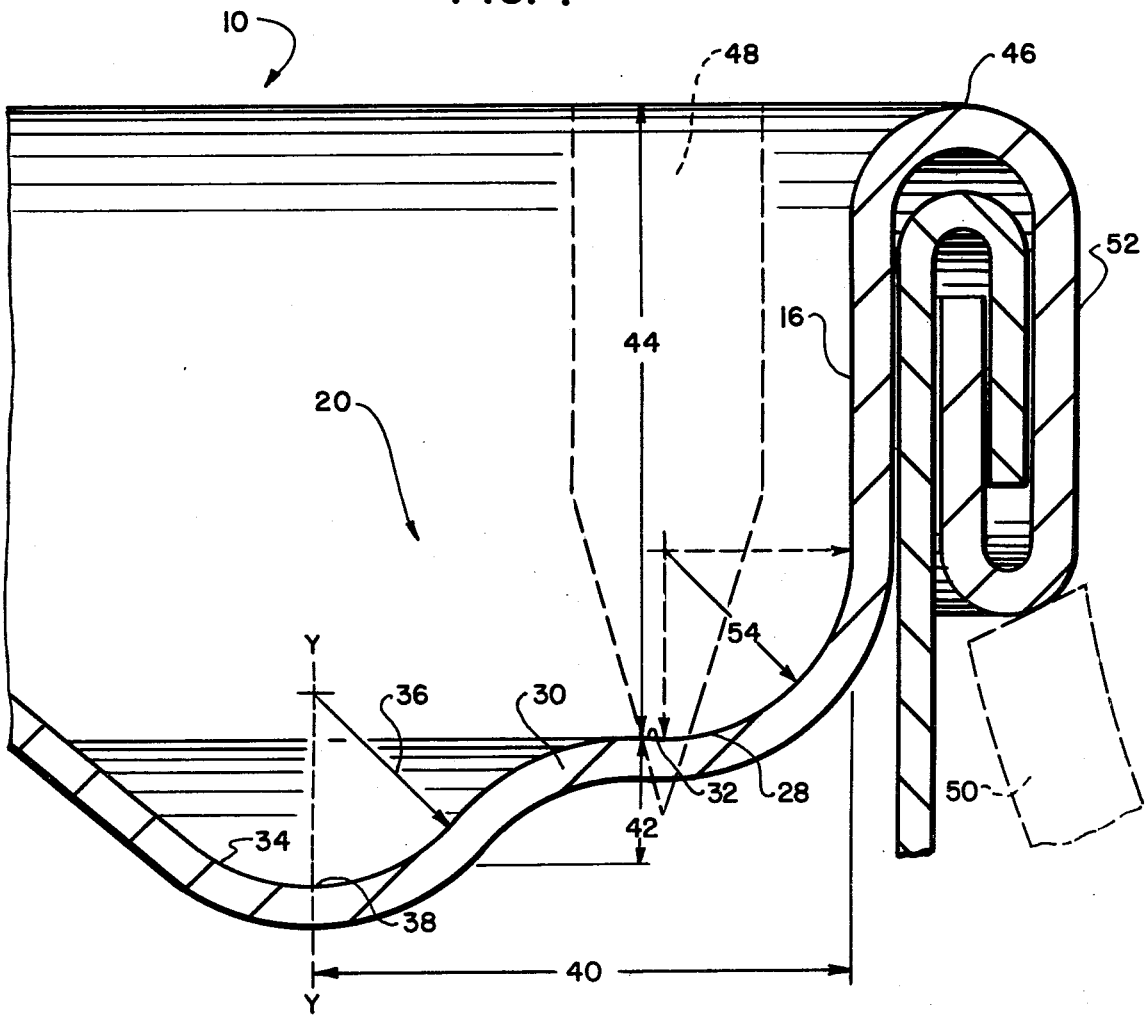

WARP RESISTANT CLOSURE FOR SANITARY CANS

BACKGROUND OF THE INVENTION

This invention relates to closures for cans and more particularly to closures for sanitary or food cans which are subjected to high temperatures and pressures during the retorting process. These can ends must be designed to withstand the pressures developed within the can during processing and pasteurization to avoid permanent distortion or buckling. The ability of the end to withstand these forces depends not only on the proper selection of the plate composition and thickness but upon the design of the end as well. A downwardly directed annular bead is introduced concentric with and inwardly adjacent to the countersink groove. This bead reinforces the end adding strength and rigidity to enable the end to resist or even overcome any buckling tendency. For the packaging of dog food which is subjected to severe processing conditions can ends with a pair of concentric down beads have occasionally been employed. The ends are further contoured with a series of transitional steps or panels inward of the bead. These steps contribute to the pull back or spring back strength of the end which enable an end which has bulged to pull back into shape when the pressure gradient across the end has been reduced as for example when the retorted can is cooled.

End distortion can occur during service as well as during processing. For example cans packaged with dog food in a west coast cannery at sea level and shipped over the Rocky Mountains to Denver were found to be permanently distended. The distended end makes the can look as if the contents were spoiled, when in fact the real problem was to increase the end strength to better resist distortion under the low atmospheric pressures encountered in shipment.

In the continuing efforts of container manufacturers to improve material efficiency or utilization there has been a trend toward the use of stronger but lighter weight plate such as DR8 or DR9. This plate is double cold reduced where the steel plate is subjected to two cold working stages rather than the single stage which is conventionally employed. The resulting product is harder and has a higher tensile strength than conventional plate but it is also less ductile. As a result when a sanitary closure is formed from light basis weight plate, such as 75 lbs/BB or 85 lbs/BB, (BB=31360 square inches) the beading and paneling convolutions which strengthen the end serve to generate the collateral problem of end warpage.

Such warpage occurs in the unseamed end and is independent of the distortion which may occur during product retorting or in subsequent service. The warpage appears to result from the unbalanced stresses which are introduced into the end during manufacture. Thus by drawing a high reenforcing bead in an end panel fabricated from high strength light weight plate, the rididity and strength may be achieved, but at the sacrifice of planarity.

A warped end if placed flange down on a flat surface will contact the surface along only a portion of its periphery, whereas an unwarped end being planar will contact the flat surface around the entire periphery. While modest warping can be tolerated, excessive warping result in end seaming and end stacking problems. The present invention addresses the problem of strengthening the end without inducing excessive warpage and further recognizes the need for such a solution to be compatible with basic requirements such as openability.

Accordingly it is an object of this invention to provide an end fabricated of light weight high strength steel plate which is suitable for use as a closure for a sanitary can. It is further an object of this invention to provide an end which has been strengthened to resist permanent distortion in service, but where the stresses resulting from the strengthening are balanced to avoid inducing warpage of the unseamed end.

Finally it is an object of this invention to provide an end which has been strengthened to resist distortion in service, but where the end conforms to conventional practice so that the resulting can may be readily opened with a conventional can opener.

SUMMARY OF THE INVENTION

It may be seen that the aforementioned objects of the invention may be attained in a closure for a sanitary can body which includes a central panel, an upwardly directed reenforcing bead radially outwardly thereof, a terminal peripheral flange and an upwardly directed countersink groove.

The central panel extends laterally outward from a centrally disposed longitudinal axis of rotation. The upwardly directed reenforcing bead is disposed above the plane of the central panel and outward thereof. At least one step panel is disposed between the bead and the central panel serving as a transitional panel to join these two elements. The terminal peripheral flange is disposed outward of the said bead and above the plane thereof. The terminal flange includes an outer most portion which is curled for interleafing with the body, a crest or upper most element and an inner downwardly directed countersink wall. The upwardly directed countersink groove is disposed between the flange and bead and includes a floor panel and an outer concave arcuate wall portion. The outer arcuate wall portion joins the floor panel with the countersink wall. An inner arcuate wall portion merges the floor panel with the outer wall of the down bead, the improvement to enhance the strength of the closure without inducing substantial warpage comprising:

The countersink groove, which includes a floor panel having a planar shelf and an outer concave arcuate wall portion which merges the shelf with the aforementioned countersink wall. An convex arcuate wall portion is incorporated in the floor panel being disposed below the plane of the shelf. The said convex portion has an outer wall which smoothly merges with the shelf and an inner wall which smoothly merges with the lowermost portion of the groove and thence into the reinforcing bead. The convex portion and the reinforcing bead cooperate to strenghten the closure and maintain the planarity of the shelf and rim crest.

The countersink groove is preferably formed with a predetermined radius of curvature of the concave outer arcuate wall portion of 0.037" and a predetermined radius of curvature for the convex portion of 0.040".

The upwardly directed lowermost surface of the groove is preferably formed with a root, or lower most portion which is 0.020" below the plane of the shelf and wherein the origin of the radius of the at the lowermost groove portion is located on an axis normal to the groove lowermost portion at the root.

The root of the lowermost portion of the groove is preferably on a plane which includes the central panel.

The closure is preferably fabricated of high temper plate such as DR8 or DR9.

The closure is preferably fabricated of light weight steel which ranges between 75–85 pounds per base box.

BRIEF DESCRIPTION OF THE DRAWINGS

FIG. 4 is a greatly enlarged cross sectional elevation of the area of the countersink groove of the strengthened warp resistant closure after seaming to a can body. The blade and drive wheel of a can opener are shown in phantom.

FIG. 5 is a partial sectional view of a portion of prior art sanitary can closure extending from the axis of rotation x″—x′ outward to and including the seaming flange.

DETAILED DESCRIPTION OF THE ILLUSTRATED EMBODIMENT

Figure 1:
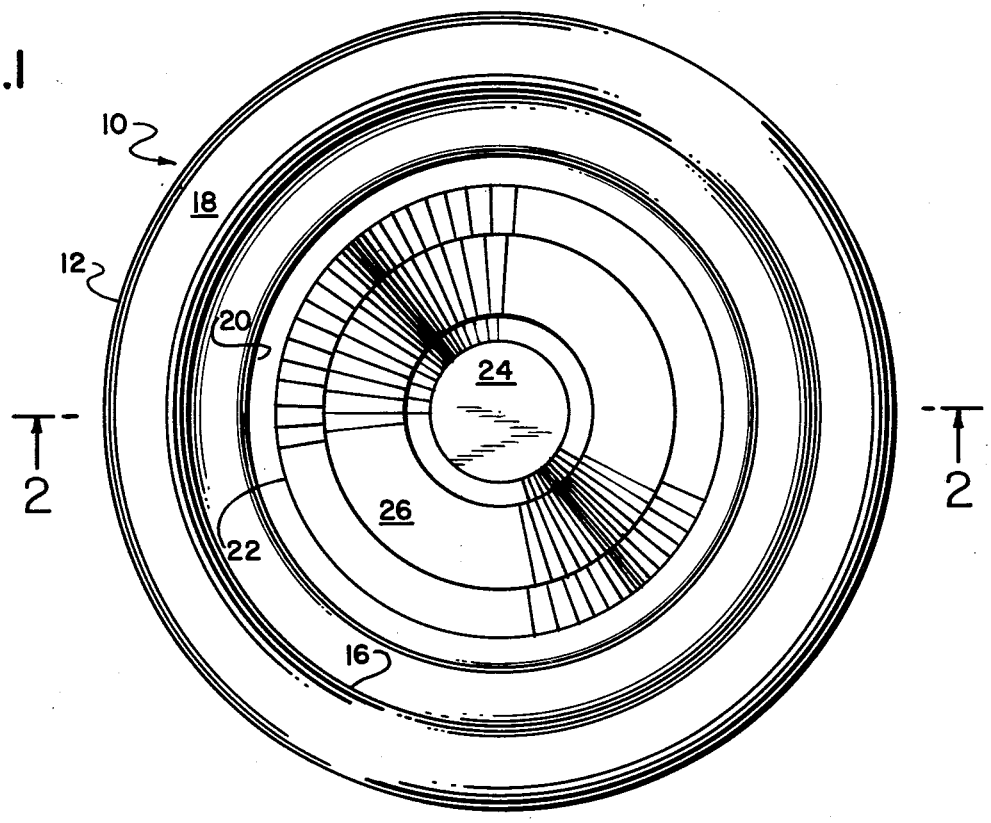
FIG. 1 is a plan view of the unseamed strengthened warp resistant sanitary can closure.

Turning now to the drawing. In FIG. 1 the strengthened warp resistant sanitary can closure 10 is shown in plan. The closure is formed with a terminal peripheral flange 12 the end 14 of which is curled for seaming to a can body in the conventional manner. The axially downwardly extending countersink wall 16 is inward of the flange crest 18 and is substantially perpendicular to a plane drawn tangent to the crest. The countersink groove 20 joins the countersink wall with a downwardly directed reenforcing bead 22. The downwardly directed reenforcing bead is joined to central panel 24 by a step panel 26.

Figure 2:
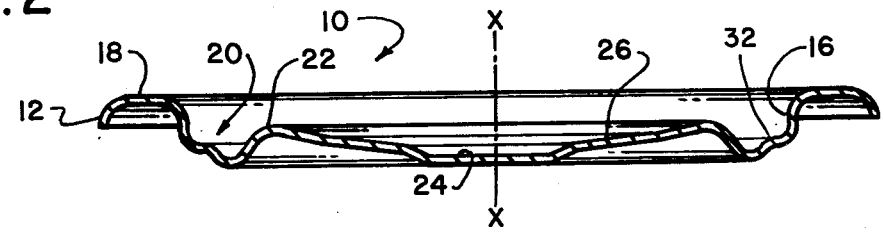
FIG. 2 is a sectional view of the closure of FIG. 1 taken along the line 2—2 and showing the axis of rotation x—x.

FIG. 2 shows a sectional view of the unseamed closure taken along the line 2—2 of FIG. 1.

Figure 3:
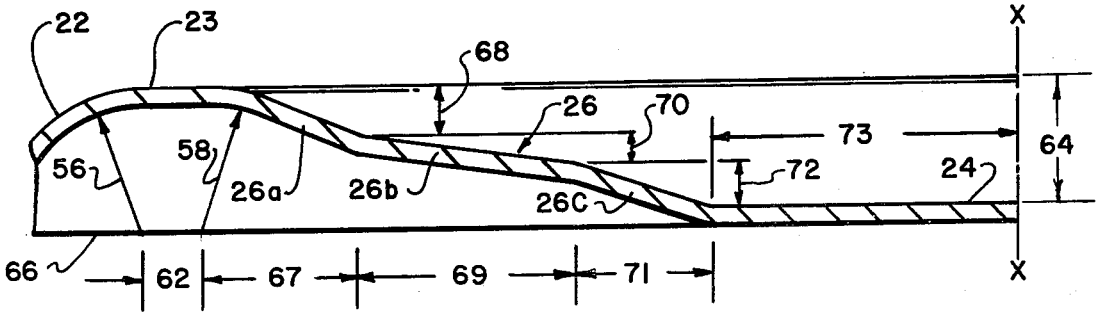
FIG. 3 is an enlarged fragmentary sectional view of a portion of the closure of FIG. 2 extending from the axis of rotation x—x outward to but not including the countersink groove.

In FIG. 3 a fragmentary portion of the closure 10 of FIG. 2 is shown from the axis of rotation x—x outward to but not including the countersink groove. FIG. 3 is enlarged to show the structural features.

In FIG. 4 the area from the countersink groove outward is shown greatly enlarged to emphasize the distinguishing structural features. The portion of the closure is shown double seamed to a container body, with the blade and drive wheel of a can opener shown in phantom.

The countersink groove 20 comprises an outer arcuate and concave wall portion 28 and a floor panel 30 which includes a planar shelf 32 and an arcuate lowermost groove portion which is defined by a predetermined radius of curvature 36 which is equal to 0.040″. The origin of this radius is located an axis Y—Y which is normal to the bead root 38, the root is the lower most portion or bottom of the countersink groove. It is disposed inward of the countersink wall by a distance 40 which is equal to 0.110″. The depth of the groove from the shelf 32 to the root 38 is a distance 42 equal to 0.020″.

The planar shelf 32 of the floor 30 of the countersink groove 20 is located a distance 44 equal to 0.117″ before seaming and 0.125″ after seaming below the rim 46 of the closure. This distance ensures engagement of the shelf by the blade of a conventional can opener 48 shown in phantom in FIG. 4. Item 50 also in phantom represents the drive wheel of the can opener which engages the lower radius of double seam 52. The planar shelf is smoothly merged with the outer convex wall at 30 and is joined to the countersink wall 16 with an arcuate wall portion 28 defined by a predetermined radius of curvature 54 equal to 0.037″. The origin of radius 54 is equidistant from countersink wall 16 and planar shelf 32.

The upwardly directed convex reenforcing bead 22 best seen in FIG. 3, is defined by two equal radii 56 and 58 which are equal to 0.065″. The origin of the two radii are located on a plane 66 which is tangent to the lower surface of root 38 which plane also intercepts the lower surface of central panel 24. Radius 56 origin is inward of the countersink wall 16 by a distance equal to 0.223″. Radius 59 origin is inward of origin 56 by a distance 62 equal to 0.035″. The resulting down bead has a corresponding plateau or flat 23 equal to 0.035″ and directly over gap 62. Radius 56 merges smoothly with radius 36 to form a continuous steeply ascending wall with a point of inflection proximate the intersection with the plane of shelf 32.

The inward portion 26 of the closure from the lowermost portion of the groove to the central panel comprises a transitional step to accommodate the variation in the elevation between the central panel and the plateau 23 of the reinforcing bead. This variation in height is designated by dimension 64 and accordingly is 0.065″ for 75 lb plate. While the step panel configuration is not believed to be critical to the invention and may, in fact, vary with end diameter, the following structure has been successfully employed in a closure for a 307 diameter sanitary can.

The transitional panel 26 is made up of three planar sloping sub panels **26*a*, 26*b* and 26*c***, as shown in FIG. 3. Each portion is smoothly merged with the adjacent portion to avoid sharp lines of demarcation which might serve as concentrative points of stress.

Sub panel **26*a* is adjacent to the inner arcuate portion of reinforcing bead 22 as defined by radius 58. Sub panel 26*a* is tangent to the arcuate portion and extends laterally inward for a distance of 0.109″ (dimension 67) from origin 58 to its mergence with sub panel 26*b*. Sub panel 26*a* drops in elevation by 0.035″ (dimension 68**).

Sub panel **26*b* extends laterally inward of the a-b junction for a distance of 0.201″ (dimension 69). The drop in elevation from junction a-b to junction b-c is 0.006″ (dimension 70**).

Sub panel **26*c* extends laterally inward of the b-c junction for a distance of 0.090″ (dimension 71) where it joins central panel 24**. The corresponding drop in elevation is 0.024″ dimension 72).

In FIG. 5 a portion of corresponding prior art closure is shown. The closure extends laterally outward from the central axis of rotation x′—x′. In this case the countersink groove 120 is shown with the conventional planar floor 130 and without the novel up bead of the instant invention. The outer arcuate wall portion is defined by radius 154 which is equal to 0.037″. The inner arcuate wall portion is defined by radius 155 which is equal to 0.062″. It should be noted that the wall segment which encompasses the inner arcuate portion of the countersink groove and the outer arcuate portion of the down bead is more steeply ascending in the instant closure 10 than in the prior art closure 110. In the instant closure the wall segment ascends 0.065" in 0.113" of inward lateral displacement whereas in the prior art structure the corresponding wall segment ascends 0.047" in 0.128" of inward lateral displacement.

It should further be noted that in the instant closure 10 plane 66 drawn tangent to the lower most surface of the groove at 38 is coplanar with central panel 24, whereas in the prior art a corresponding plane drawn tangent to the floor of the countersink groove is not coplanar with the central panel 124.

While FIG. 3 relates specifically to the warp resistant end 10, except for the above two notations the dimensions and structure are substantially the same for the prior art end 110.

A representative sample of ten of the instant warp resistant ends 10 was compared with ten prior art ends 110 with the following results:

Warp resistant ends showed an average warpage of 0.0141" with a range of 0.0045"–0.0230".

Prior art ends showed an average warpage of 0.0255" with a range of 0.0223–0.0303". The strength of the ends were substantially equivalent.

Thus it can be seen that the instant structure has provided an end closure which can be fabricated of light weight high strength steel plate and which will resist distortion and facilitate its use in commercial seaming operations.

It may further been seen that the closure is compatible with the design of commercial can openers.

What is claimed is:

1. A warp resistant can body end closure of light gage metal configured to enhance warp resistance and resist distortion when subjected to differential pressures on opposite sides thereof, said end closure comprising, a terminal peripheral flange at the outer periphery of the closure extending radially inwardly to a substantially horizontal flange crest prior to seaming said closure to a can body, said crest merging into a first arcuate convex portion with said convex portion in turn merging into an axially downwardly extending countersink wall, a concave arcuate wall portion extending downwardly and radially inwardly from said countersink wall and merging into a substantially planar shelf inwardly thereof, said shelf at its innermost end merging into a convex outer arcuate wall portion extending downwardly and radially inwardly to an upwardly open concave countersink groove, said groove from the bottom portion thereof extending radially and upwardly inwardly in a wall portion which merges into convex arcuate outer wall defining an upwardly directed reinforcing bead, the radially inner wall of said bead angling downwardly and merging into a downwardly inclined step panel, said step panel at its innermost periphery merging into a planar central panel surrounding the longitudinal axis of said end closure, said central panel being substantially parallel to said shelf, and substantially coplanar with the lowermost portion of said countersink groove, said central panel and said lowermost portion of said groove defining the lowest points of said end closure with respect to the interior of a said can body when seamed thereto, said terminal peripheral flange having an outer curl for double seaming to a can body, wherein said parallel relationship of said shelf and central panel on opposite sides of said groove and bead provide the antiwarp and distortion-free character of said end closure under varying ambient pressure conditions notwithstanding the light gage metal thereof.

2. The closure of claim 1 wherein said concave arcuate wall portion is defined by a first predetermined radius of curvature of 0.037" the origin of which is equidistant from said shelf and from said countersink wall and wherein said countersink groove is defined by a second radius of curvature of 0.040" whose origin is located on an axis drawn normal to said countersink groove at said lowermost portion of said countersink groove.

3. The closure of claim 2 wherein said lowermost portion of said countersink groove on the upwardly facing surface thereof is 0.020" below the plane of said shelf.

4. The closure of claim 3 wherein said closure is formed of double cold reduced steel plate having a temper ranging between DR8 and DR9.

5. The closure of claim 4 wherein said steel plate has a weight which ranges between 75 lbs per base box and 85 lbs per base box.

6. The closure of claim 5 wherein said peripheral flange of said closure is inter-leafed with the peripheral flange of a can body to form a double seam and wherein the countersink depth from the rim of said flange to said shelf is 0.117" whereby said shelf may be cuttingly engaged by the blade of a commercial can opener when said closure is joined to said can body.

* * * * *